US005256528A

United States Patent [19]

Merkel et al.

[11] Patent Number: 5,256,528

[45] Date of Patent: Oct. 26, 1993

[54] MAGENTA IMAGE-DYE COUPLERS OF IMPROVED HUE

[75] Inventors: Paul B. Merkel, Rochester; Stephen P. Singer, Spencerport, both of N.Y.; Bernard Arthur Clark, Maidenhead, England; Paul Louis R. Stanley, Wealdstone, United Kingdom

[73] Assignee: Eastman Kodak Company, Rochester, N.Y.

[21] Appl. No.: 872,880

[22] Filed: Apr. 23, 1992

[51] Int. Cl.[5] ..... G03C 1/08; G03C 7/26; G03C 7/32

[52] U.S. Cl. ..... 430/555; 430/504; 430/383; 430/387

[58] Field of Search ..... 430/555, 504, 383, 387

[56] References Cited

U.S. PATENT DOCUMENTS

| | | | |
|---|---|---|---|
| 3,907,571 | 9/1975 | Arai et al. | 430/554 |
| 3,928,044 | 12/1975 | Arai et al. | 430/554 |
| 4,351,897 | 9/1982 | Aoki et al. | 430/555 |
| 4,463,085 | 7/1984 | Mitsui et al. | 430/555 |
| 4,556,630 | 12/1985 | Furutachi et al. | 430/372 |
| 4,595,650 | 6/1986 | Furutachi et al. | 430/387 |
| 4,942,116 | 7/1990 | Renner | 430/555 |
| 4,994,359 | 2/1991 | Morigaki et al. | 430/555 |

FOREIGN PATENT DOCUMENTS

| | | |
|---|---|---|
| 37305573 | 3/1989 | Fed. Rep. of Germany . |
| 956261 | 7/1964 | United Kingdom . |
| 1530272 | 10/1978 | United Kingdom . |
| 2071647 | 9/1981 | United Kingdom . |

*Primary Examiner*—Charles L. Bowers, Jr.
*Assistant Examiner*—Geraldine Letscher
*Attorney, Agent, or Firm*—Arthur E. Kluegel

[57] ABSTRACT

A photographic element and process provide a magenta coupler of the formula:

wherein (a) at least one of X1, X2 and R1 and at least one of R2 and R3 is a substituent individually selected from carbamoyl, alkoxycarbonyl, aryloxycarbonyl, sulfamoyl, alkylsulfonyl, arylsulfonyl, alkoxysulfonyl, aryloxysulfonyl, alkylsulfoxyl, arylsulfoxyl, acyloxy, cyano, nitro, and trifluoromethyl;

(b) the substituents X1, X2, R1, R2 and R3 not selected from the (a) group may be selected from alkyl, alkoxy, aryloxy, acylamino, alkylthio, arylthio, sulfonamido, alkylureido, arylureido, alkoxycarbonylamino, aryloxycarbonylamino, and halogen and in the case of R3 hydrogen;

(c) substituents R1 and R2 are para or meta to the carbon attached to the nitrogen atom;

(d) a and b are 1 to 3;

(e) Q is an alkylthio or arylthio coupling-off group.

The element provides a deeper magenta hue and reduced blue absorption by the resulting magenta dye.

17 Claims, 1 Drawing Sheet

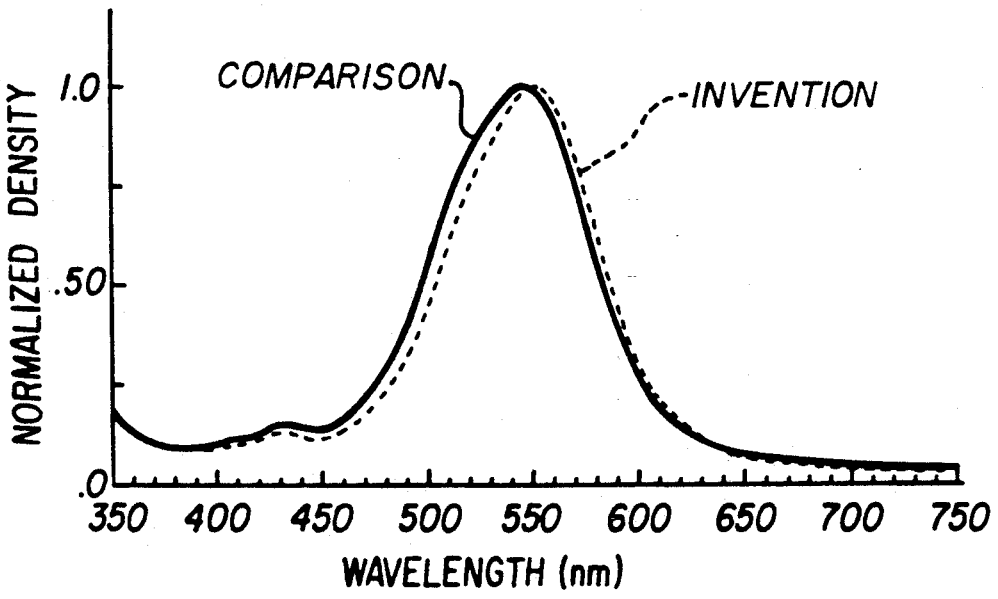
COMPARISON
INVENTION
NORMALIZED DENSITY
1.0
.50
.0
350
400
450
500
550
600
650
700
750
WAVELENGTH (nm)

MAGENTA IMAGE-DYE COUPLERS OF IMPROVED HUE

BACKGROUND OF THE INVENTION

The present invention relates to photographic coupler compositions comprising two-equivalent 3-anilino-1-phenyl-5-pyrazolone magenta dye forming couplers with strong electron-withdrawing substituents on both the 3-anilino and 1-phenyl groups and with arylthio or alkylthio coupling-off groups. The invention also relates to color photographic materials including such coupler compositions and to methods for improving the hue of magenta dyes and for providing high dye formation efficiency in such materials.

There is considerable interest in using pyrazolone magenta couplers, particularly 3-anilino-1-phenyl-5-pyrazolone couplers, as imaging couplers for photographic applications. Advantages that may be associated with the use of these couplers include low cost, high reactivity, high dye extinction coefficients and good dispersibility. Two-equivalent pyrazolone magenta dye-forming couplers with coupling-off groups in the 4-position have additional potential advantages including high efficiency of dye formation from oxidized developer, very high reactivity, low sensitivity to process pH variations, formaldehyde insensitivity and resistance to thermally induced reaction with magenta dye. However, pyrazolone magenta dye forming couplers that previously have been described suffer from disadvantages such as producing dyes with hues that are too hypsochromic upon coupling with commonly used developers, high equivalency, sensitivity to formaldehyde or the tendency to undergo side reactions that do not lead to dye formation.

Dye hues that are too hypsochromic can lead to inaccurate and objectionable color reproduction from color negative materials or directly viewed photographic materials such as color prints or color transparencies. In color negative materials magenta dyes that are too hypsochromic produce high amounts of unwanted blue light absorption and can result in prints with inaccurate color or low color saturation. The unwanted blue absorption can also cause other negative effects such as increasing the time required to print from processed negatives by necessitating larger contents of masking couplers to offset the unwanted absorption and by limiting the amounts of other blue absorbers that can be added. The use of four-equivalent couplers or of two-equivalent couplers that undergo side reactions leads to inefficiencies and increases cost. This invention identifies practical two-equivalent magenta dye forming pyrazolone couplers and coupler compositions that have high activity, that are resistant to reaction with formaldehyde or to side reactions and that yield dyes with reduced unwanted blue light absorption for more accurate color reproduction. In addition, the coupler compositions of this invention can be used to produce photographic materials in which continued coupling is suitably low in processes without a stop bath between the development and bleach steps.

It is well known in the color photographic art that color images are produced by a colored dye that is formed by coupling reaction between an oxidized color developing agent and a coupler. Various improved 5-pyrazolone magenta-dye-forming couplers have been described since issuance of U.S. Pat. No. 1,969,479. Improvements that have been noted include substitution of halogen atoms or of alkoxy groups in the ortho position of the 3-anilino group for improved spectral properties, as described in British Patent GB 956,261. U.S. Pat. No. 3,928,044 describes the use of 3-anilino-5-pyrazolone couplers with alkoxycarbonyl groups in the meta or para positions of the 3-anilino ring, and U.S. Pat. No. 3,907,571 describes 3-anilino-5-pyrazolone magenta dye-forming couplers with sulfamoyl substituents in the meta or para positions of the anilino ring. However, the extent of the bathochromic hue shifts and of the reductions in unwanted blue light absorption by such dyes are less than normally desired for optimum color reproduction. Similarly, the couplers described in U.K. Patent Application 2,071,647 do not yield dyes that are sufficiently bathochromic for many applications.

U.S. Pat. Nos. 4,351,897 and 4,556,630 disclose two-equivalent 3-anilino-5-pyrazolone couplers with specific arylthio coupling-off groups. These patents do not consider structures that yield bathochromic dyes having low unwanted blue light absorption in accordance with the invention. German Patent Application DE 3,730,557 describes two-equivalent 3-anilino-5-pyrazolone couplers with thio coupling-off groups used in combination with carbonamide oil formers, but also does not deal with structures that yield bathochromic dyes with low unwanted blue light absorption.

Item 16736 in Research Disclosure, March 1978 describes 3-anilino-5-pyrazolone couplers with alkylsulfonyl substituents in the meta or para positions of the 3-anilino ring. These may also have alkylsulfonyl or arylsulfonyl substituents on the 1-phenyl group. However, examples of two-equivalent 3-anilino-5-pyrazolone couplers are not specifically included in this disclosure. U.K. Patent Specification 1,530,272 describes 3-anilino-1-phenyl-5-pyrazolone couplers with alkylsulfonyl or sulfamoyl substituents on the 1-phenyl group. These may also have strong electron-withdrawing sulfamoyl or carbamoyl substituents on the 3-anilino group. While various possible coupling-off groups are noted in U.K. Patent Specification 1,530,272, no specific structural examples with arylthio or alkylthio coupling-off groups are provided, and illustrative Examples 1 and 2 are restricted to four-equivalent couplers. Thus, U.K. Patent Specification 1,530,272 does not disclose couplers having the appropriate 3-anilino and 1-phenyl substituents as well as suitable coupling-off groups that provide all of the beneficial properties of the couplers of this invention.

U.S. Pat. No. 4,595,650 discloses photographic materials containing pyrazolone couplers of the 3-anilino or 3-acylamino types containing an arylthio group at the coupling position with an alkoxy or aryloxy substituent substituted in a specified manner. One of the 50 odd structures exemplified shows a strong electron withdrawing group in both rings but one of these is the undesirable acyl group. The use of acyl ring substituents is undesirable because these groups are difficult to synthesize, and they tend to be deleterious to the photographic properties, particularly light stability. No mention is made in the patent of the advantageous bathochromic properties obtained in this invention. Further, it has been found that arylthio coupling off groups containing an ortho alkoxy substituent exhibit undesirably stable leuco dyes.

In general, pyrazolone magenta couplers provide dyes that have the inherent property of absorbing some blue light which is undesirable because these dyes are ideally responsive to green light only. To keep the color record correct, it is necessary to include in the film a masking coupler which functions to provide a similar blue absorbance in the non-image areas corresponding to the unwanted blue absorbance in the image area caused by the magenta dye formed. Thus, the unwanted blue absorption is a problem which may require the addition of a mask. Also, the unwanted blue absorption adversely affects the ability to include image modifiers for sharpness etc. which generate dyes with unwanted blue absorption and also can prolong the printing time for processed negatives having the excess blue absorbance.

An embodiment of this invention relates to employing the photographic materials in combination with a dispersion of magnetic particles. U.S. Pat. No. 4,990,276 and EP 0 459 349 Al provide background on such dispersions and photographic materials. The coupler materials herein provide an effective way of counteracting unwanted blue light absorption by the magnetic layer in processed negatives during the printing of processed negatives.

It would be desirable to provide coupler compositions and color photographic materials having useful photographic properties and that yield bathochromic magenta dyes with reduced unwanted blue light absorption, particularly those that have high activity, that have low equivalency and that are free from side reactions, and which may be used for the efficient formation of magenta dyes in color photographic materials. It is further desirable to provide magenta dye forming coupler compositions and photographic materials of low cost, whose dye forming characteristics have low sensitivity to variations in developer pH, exhibit low continued coupling in seasoned bleach solutions, do not require stabilization with formaldehyde solutions and have stable magenta dye images, and which most preferably have a reduced tendency to form stable leuco dyes.

SUMMARY OF THE INVENTION

The invention encompasses a photographic material comprising a support bearing at least one photosensitive silver halide emulsion layer having associated therewith a magenta dye-forming coupler having the formula:

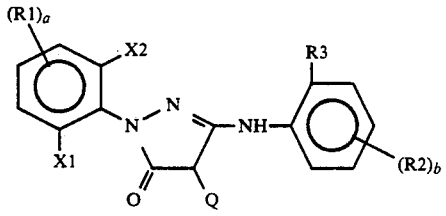

wherein (a) at least one of X1, X2 and R1 and at least one of R2 and R3 is a substituent individually selected from carbamoyl, alkoxycarbonyl, aryloxycarbonyl, sulfamoyl, alkylsulfonyl, arylsulfonyl, alkoxysulfonyl, aryloxysulfonyl, alkylsulfoxyl, arylsulfoxyl, acyloxy, cyano, nitro, and trifluoromethyl;

(b) the substituents X1, X2, R1, R2 and R3 not selected from the (a) group may be selected from halogen, alkyl, alkoxy, aryloxy, acylamino, alkylthio, arylthio, sulfonamido, alkylureido, arylureido, alkoxycarbonylamino, aryloxycarbonylamino, and in the case of R3 hydrogen;

(c) substituents R1 and R2 are para or meta to the carbon attached to the nitrogen atom;

(d) a and b are 1 to 3; and (e) Q is an alkylthio or arylthio coupling-off group.

The invention also encompasses a process for improving photographic materials having unwanted blue absorption.

BRIEF DESCRIPTION OF THE DRAWINGS

The FIGURE is a graph showing the magenta dye absorption spectra obtained using the coupler of the invention (M11) and a comparison coupler (B5) as more fully described in Example 5.

DETAILED DESCRIPTION OF THE INVENTION

The two-equivalent 3-anilino-1-phenyl-5-pyrazolone magenta-dye-forming couplers of this invention are represented by generic formula I:

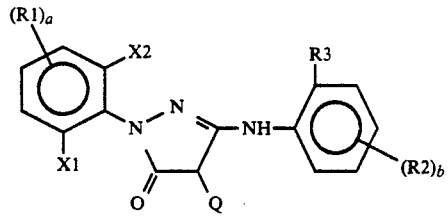

I wherein:

(a) at least one of X1, X2 and R1 and at least one of R2 and R3 is a substituent individually selected from, carbamoyl, alkoxycarbonyl, aryloxycarbonyl, sulfamoyl, alkylsulfonyl, arylsulfonyl, alkoxysulfonyl, aryloxysulfonyl, alkylsulfoxyl, arylsulfoxyl, acyloxy, cyano, nitro and trifluoromethyl;

(b) the substituents X1, X2, R1, R2 and R3 not selected from the (a) group may be selected from alkyl, alkoxy, aryloxy, acylamino, alkylthio, arylthio, sulfonamido, alkylureido, arylureido, alkoxycarbonylamino, aryloxycarbonylamino, and halogen and, in the case of R3, hydrogen;

(c) substituents R1 and R2 are para or meta to the carbon attached to the nitrogen atom;

(d) a and b are 1 to 3; and (e) Q is an alkylthio or arylthio coupling-off group.

It is understood throughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form but also its form substituted with any substituents which do not negate the advantages of this invention. Usually the organic substituents have less than 30 carbon atoms and typically less than 20 carbon atoms.

Examples of suitable specific substituents include the following: sulfamoyl, such as N-methylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as N-methylsulfamido and N-octdecylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyooxysulfonyl, and 2-ethylhexyloxysulfonyl; aryloxysulfonyl, such as phenoxysulfonyl, 2,4-di-t-pentylphenoxysulfonyl. Alkanesulfonyl, such as alkanesulfonyl containing 1 to 30 carbon atoms, for example methanesulfonyl, octanesulfonyl, 2-ethylhexanesulfonyl,and hexadecanesulfonyl; arenesulfonyl, such as benzenesulfonyl, 4-nonylbenzenesulfonyl, and p-toluenesulfonyl;

In the preferred embodiment the coupling-off group Q is of the general formula:

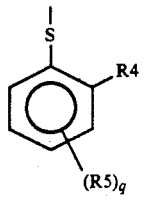

wherein R4 and R5 are individually selected from alkyl, alkoxy, aryloxy, carbonamido, ureido, carbamate, sulfonamido, carbamoyl, sulfamoyl, acyloxy, alkoxycarbonyl. aryloxycarbonyl, amine, halogen, hydrogen and carboxyl; and wherein q is 0, 1 or 2. Preferably, R4 and R5, when present, are carbonamido or alkyl. The total number of carbon atoms in R4 and R5 taken together is at least 4 but not greater than 25. It is particularly preferred that R4 has at least one carbon atom. Even more preferably, the pi value (as hereafter described) of the combined R4 and R5 substituents is at least 2.5. Pi values are partition coefficients which measure the hydrophilic/hydrophobic nature of a substituent (more positive means more hydrophobic). See for example "Substituent Constants for Correlation Analysis in Chemistry and Biology," Wiley, New York, N.Y., 1979.

Couplers in which R4 or R5 is a substituted or unsubstituted carbonamido and/or alkyl as especially preferred for ease of synthesis, low cost and for photographic properties including a reduced level of leuco dye formation during processing.

It has been observed that couplers with arylthio coupling off groups, particularly those with an alkoxy substituent ortho to the sulfur, have a reduced tendency to form stable leuco dyes when the parent contains the electron-withdrawing groups prescribed herein.

It is preferred that the couplers of this invention and the dyes that are generated from them be of sufficient molecular weight and hydrophobicity that they undergo minimal diffusion out of the layers in which they are coated when incorporated into photographic materials. It is also desired that the couplers of this invention be soluble in and dispersible with high-boiling, hydrophobic, organic solvents referred to as coupler solvents (see below). To accomplish these aims the total number of carbon atoms in R1, R2 and R3 combined is preferably at least 10 and more preferably 12 to 30.

The couplers of this invention are usually utilized by dissolving them in high-boiling coupler solvents and then dispersing the organic coupler plus coupler solvent mixtures as small particles in aqueous solutions of gelatin and surfactant (via milling or an analogous procedure). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate), esters of aliphatic acids (e.g. dibutyl sebecate), alcohols (e.g. 2-hexyl-1-decanol), phenols (e.g. p-dodecylphenol), carbonamides (e.g. N,N-diethyldodecanamide, N,N-dibutyldodecanamide, or 1-hexadecyl-2-pyrrolidinone), sulfoxides (e.g. bis(2-ethylhexyl sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios typically range from about 1:0.1 to 1:10.

Especially useful coupler solvents for the practice of the invention are phosphates, carbonamides and sulfoxides. The carbonamides are particularly useful in that there are a number of inexpensive carbonamide coupler solvents that produce benefits such as reduced continued coupling in bleach solutions and improved image stability. Dye hues obtained using carbonamide coupler solvents are often more hyposochromic than desirable. When the couplers of this invention are used together with carbonamides, excellent dye hues can be obtained along with low continued coupling and good image stability. Thus, the couplers of this invention permit a greater choice of coupler solvents and allow construction of improved photographic materials.

Carbonamide compounds or coupler solvents useful for the practice of this invention are represented by the generic formula II, $$R6\overset{\overset{\displaystyle O}{\|}}{C}NR7R8 \qquad \text{II}$$

wherein, R6, R7 and R8 are individually selected from the group consisting of straight chain, branched or cyclic alkyl groups, straight chain or branched alkenyl groups and straight chain or branched alkylene groups (forming bis compounds or rings), any of which may be substituted with one or more substituents selected from the group consisting of alkoxy, aryloxy, aryl, alkoxycarbonyl, aryloxycarbonyl, acyloxy and halogen; a phenyl group; and a phenyl group containing one or more substituents selected from the group consisting of alkyl, alkoxy, aryloxy, alkoxycarbonyl, aryloxycarbonyl, acyloxy and halogen (e.g. chloro); and wherein R6, R7 and R8 combined contain at least 12 carbon atoms and preferably 15–30 carbon atoms to minimize volatility, water solubility and diffusivity. R6 and R7 or R7 and R8 may join to form a ring. For example, R6 and R7 may join to form a five-membered pyrrolidinone ring.

The coupler compositions of this invention may contain various addenda for improved photographic performance. These include aniline and amine addenda such as those described in U.S. Pat. Nos. 4,483,918 and 4,585,728, which may reduce stain from continued coupling and other sources and may also improve image stability. Other stabilizing addenda such as phenols, chromanols and alkoxy benzenes may also be incorporated with the couplers of this invention.

Particularly useful in combination with the 3-anilino-1-phenyl-5-pyrazolone couplers of this invention are aniline compounds represented by the formula

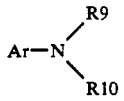

III wherein R9 represents an alkyl, aralkyl, cycloalkyl or alkenyl group, any of which may be substituted; R10 is a hydrogen or a substituent defined the same as R9; Ar is a phenyl or substituted phenyl group. Phenyl substituents include one or more alkyl, aralkyl, alkenyl, cycloalkyl, alkoxy, aryloxy, phenyl or acylamino groups. R9 and R10 may be bonded to form a ring. R9 and Ar may also be joined to form a ring. Together R9, R10 and Ar should contain at least 12 carbon atoms and preferably about 20 to 40 carbon atoms. Straight chain or branched alkyl R9 and R10 groups are preferred, and alkyl or alkoxy substituted Ar groups are preferred. Particularly preferred are Ar groups which are substituted with alkoxy groups ortho to the amino group. The latter may have additional substituents on Ar such as straight chain or branched alkyl groups.

Examples of two-equivalent 3-anilino-1-phenyl-5 pyrazolone magenta dye forming couplers of this invention include, but are not limited to, the compounds with the "M" prefix:

M1

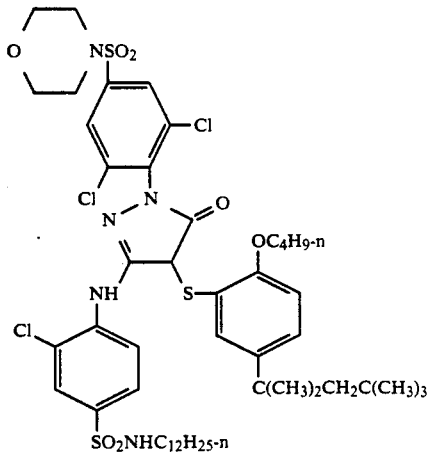

-continued

M2

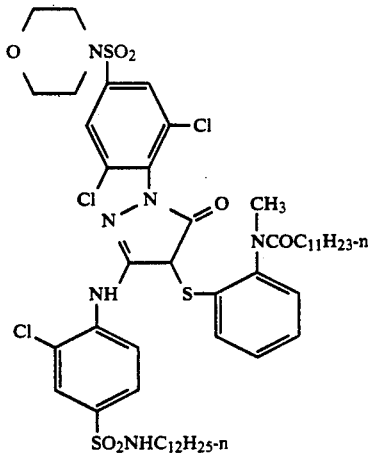

M3

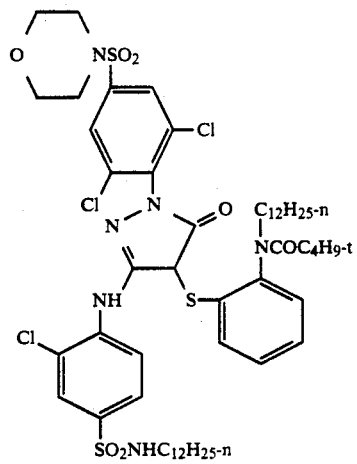

M4

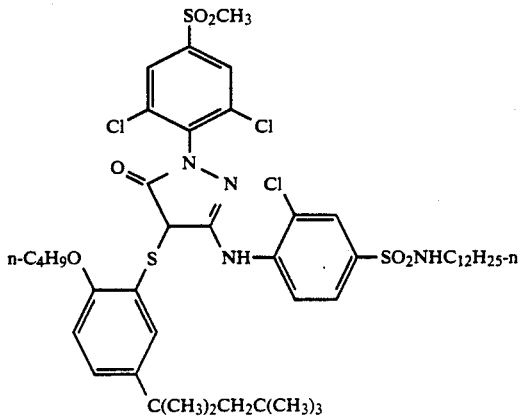

-continued
M5
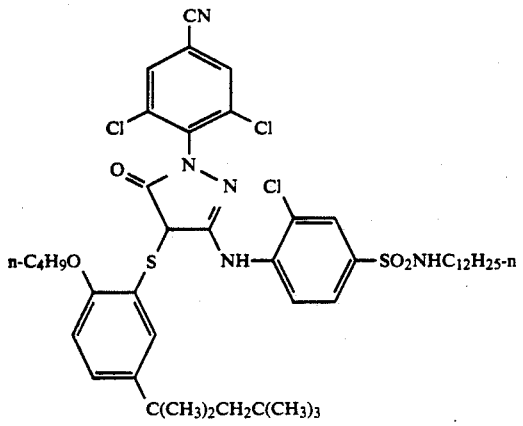
M6
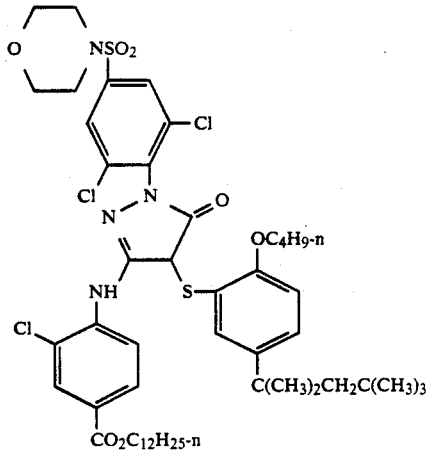
M7
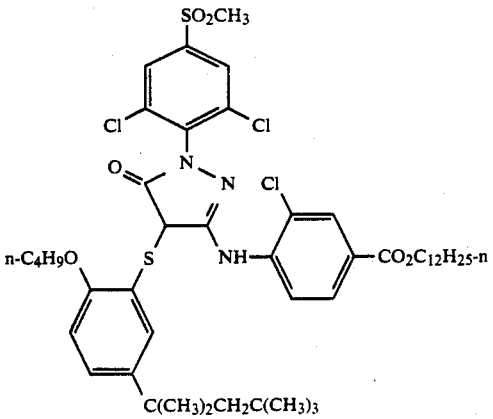
-continued
M8
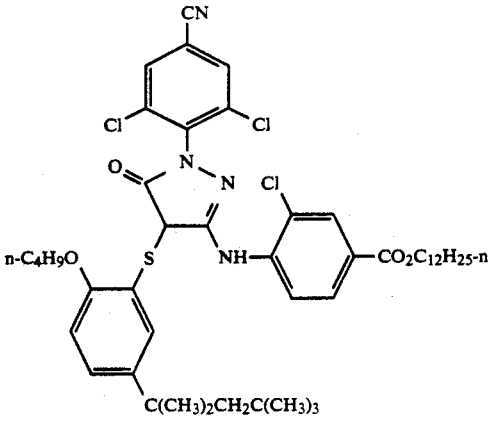
M9
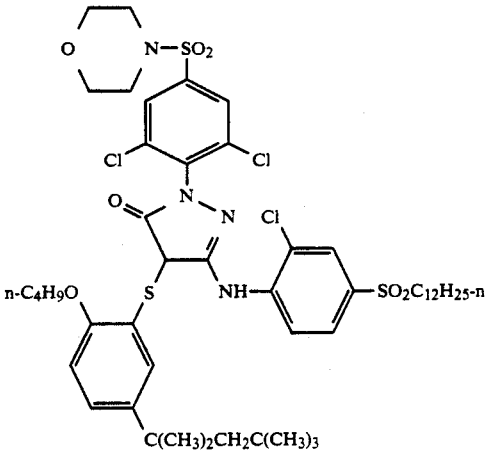
M10
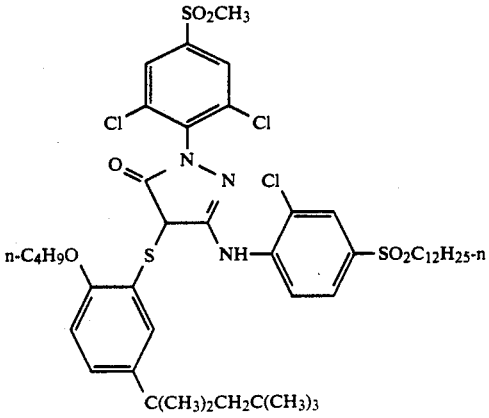

-continued
M11
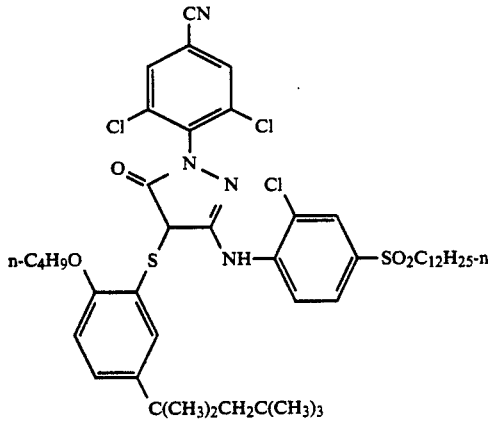
M12
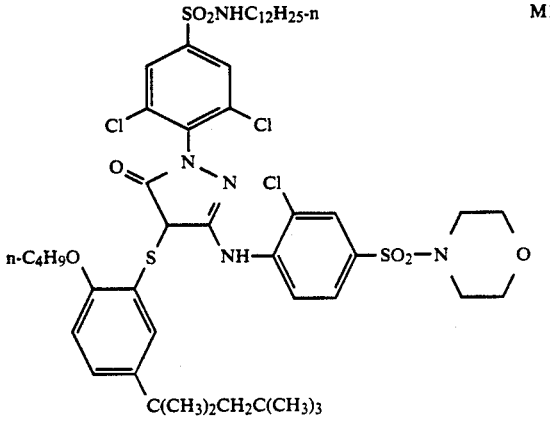
M13
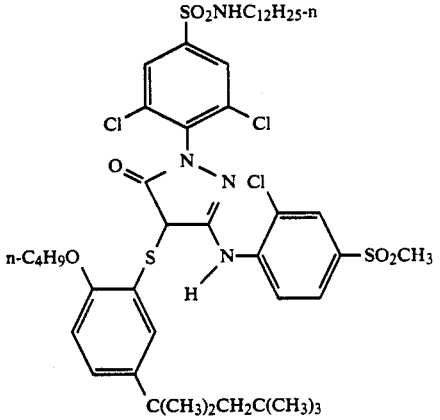
M14
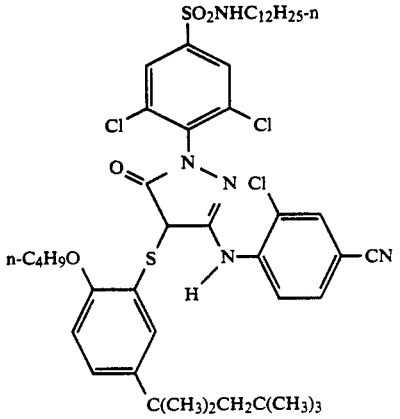
-continued
M15
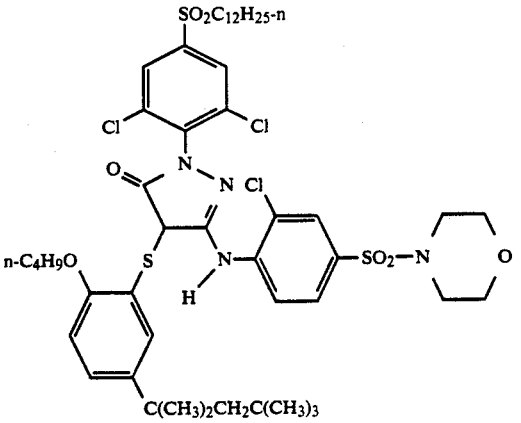
M16
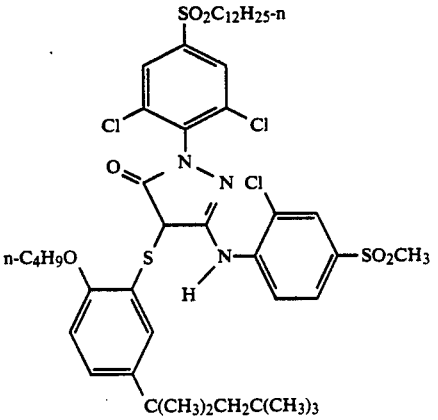
M17
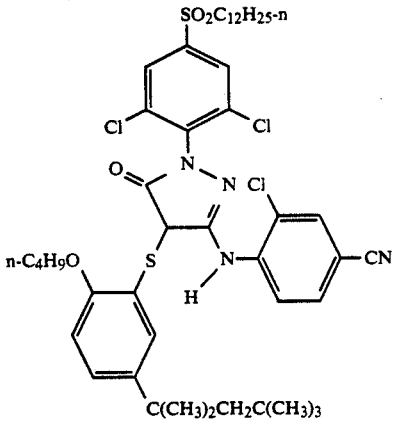
M18
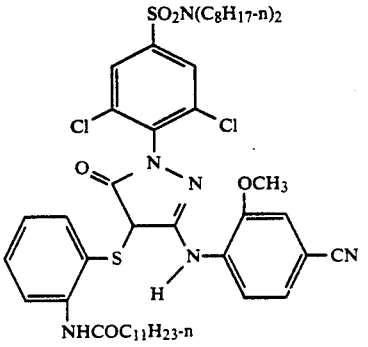

-continued
M19
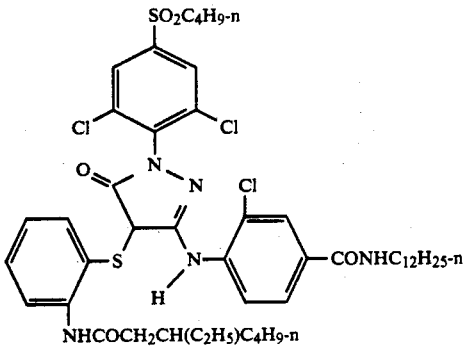
M20
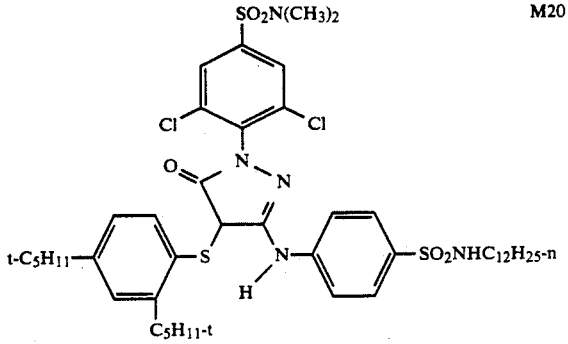
M21
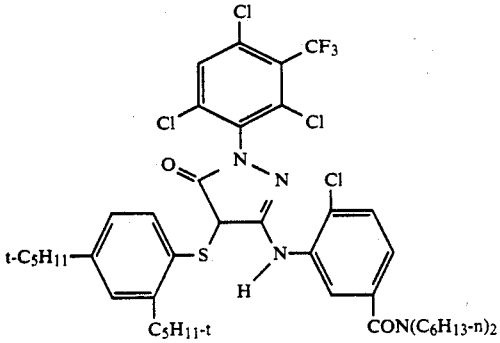
M22
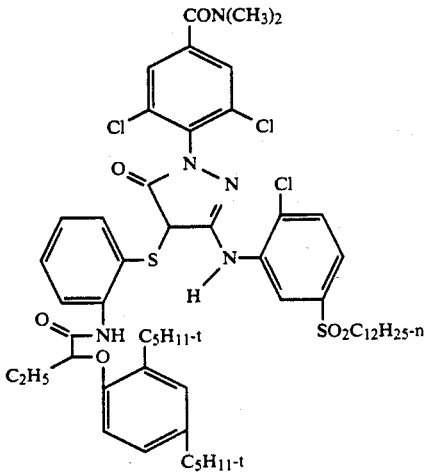
-continued
M23
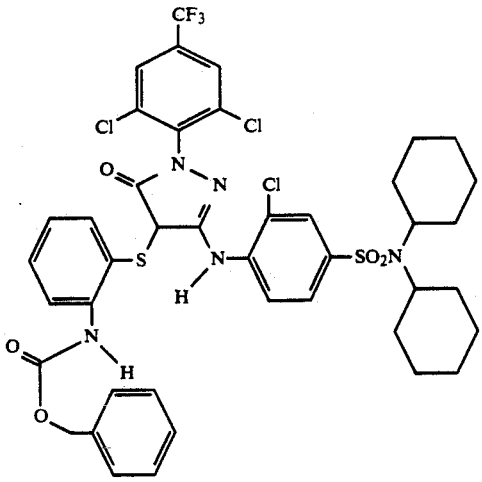
M24
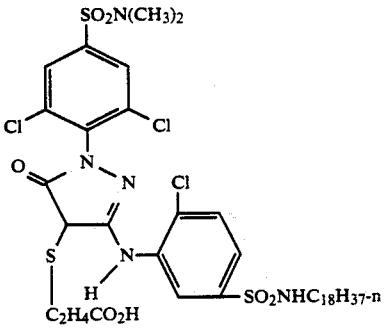
M25
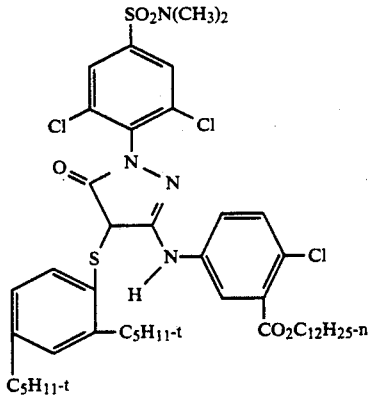
M26
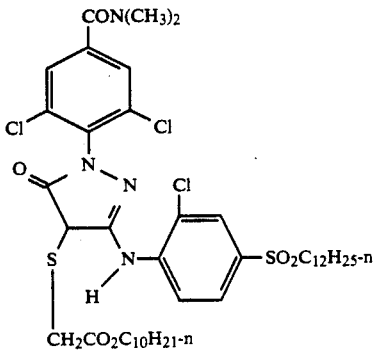

-continued
M27
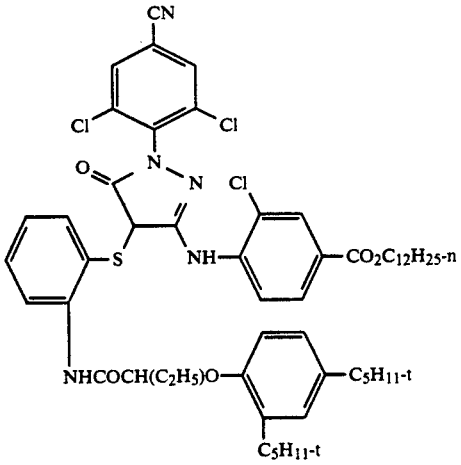
M28
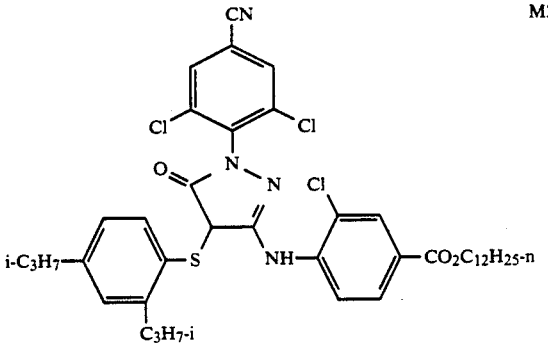
M29
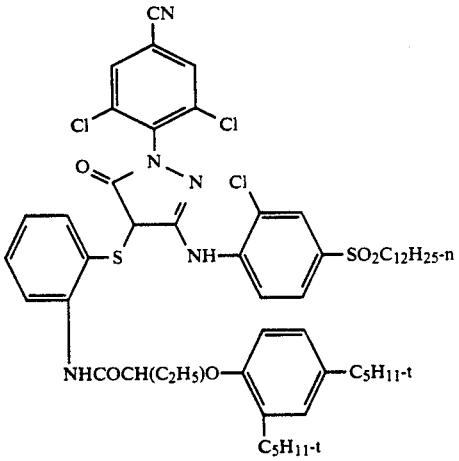
M30
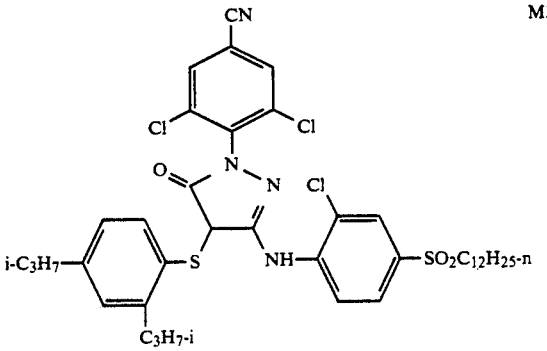
-continued
M31
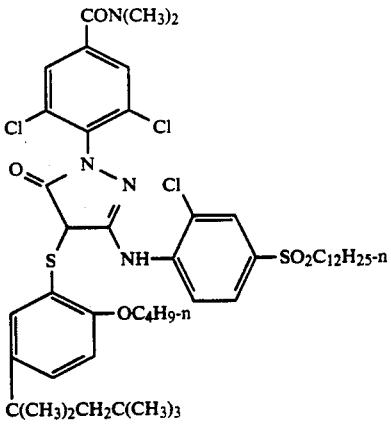
M32
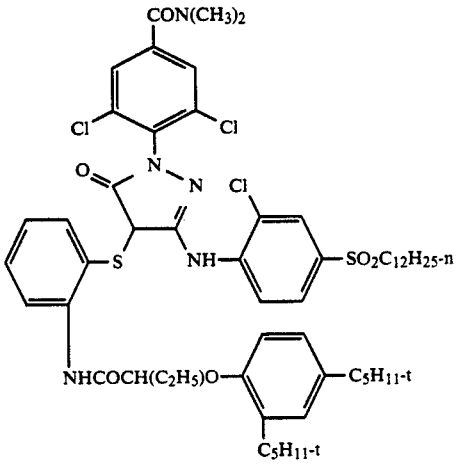
M33
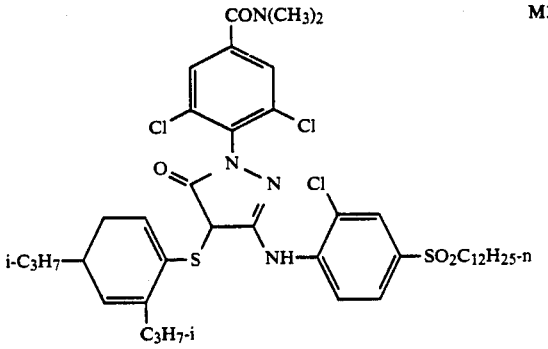
Examples of carbonamide coupler solvents (II) useful in combination with the 3-anilino-1-phenyl-5-pyrazolone couplers of this invention include, for example, the compounds with the "C" prefix.
$n\text{-}C_{11}H_{23}CON(C_2H_5)_2$ C-1
$n\text{-}C_{11}H_{23}CON(C_4H_{9}\text{-}n)_2$ C-2
C-3
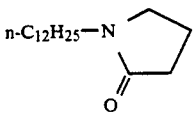

-continued

C-4

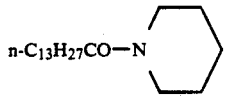

C-5

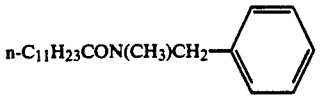

C-6

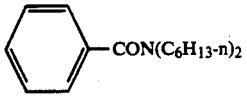

Examples of aniline addenda (III) useful in combination with the 3-anilino-1-phenyl-5-pyrazolone couplers of this invention include A1 and A2:

A1

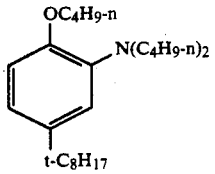

A2

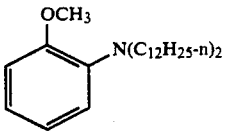

The photographic coupler compositions of the present invention are employed in color photographic materials in a manner well known in the photographic art. For example, a supporting substrate may be coated with a silver halide emulsion and a coupler composition of the present invention comprising a two-equivalent 3-anilino-1-phenyl-5-pyrazolone magenta dye forming coupler with suitable electron withdrawing substituents on both the 1-phenyl and 3-anilino groups. The photographic material may then be imagewise exposed and then developed in a solution containing a primary aromatic amine color developing agent in a manner well known in the photographic art. As further known in the art, the primary aromatic amine developing agent is oxidized in an imagewise manner by reaction with exposed silver halide grains, and the oxidized developer reacts with coupler to form dye. The development step is followed by bleaching and fixing steps or a bleach-fix step to remove silver and silver halide from the coating.

It is also contemplated that materials of the invention may be employed in conjunction with a photographic material where a relatively transparent film containing magnetic particles is incorporated into the material. The materials of this invention function well in such a combination and give excellent photographic results. Examples of such magnetic films are well known and are described for example in U.S. Pat. No. 4,990,276 and EP 459,349 which are incorporated herein by reference.

As disclosed in these publications, the particles can be of any type available such as ferro- and ferri-magnetic oxides, complex oxides with other metals, ferrites etc. and can assume known particulate shapes and sizes, may contain dopants, and may exhibit the pH values known in the art. The particles may be shell coated and may be applied over the range of typical laydown.

The embodiment is not limited with respect to binders, hardeners, antistatic agents, dispersing agents, plasticizers, lubricants and other known additives.

The couplers of the invention are especially suited for use in combination with these magnetic layers. The layer may suitably be located on the side of the photographic material substrate opposite to the silver halide emulsions and may be employed to magnetically record any desired information. One notable deficiency attributed to such a layer is that the particle layer tends to absorb blue light when light is shined through the processed negative to create a reflective color print. This distorts the color otherwise obtainable without the layer unless needed corrections are made. This also reduces the light transmission during printing so that the printing time must be increased for comparable results. In one embodiment of the invention, the coupler of the present invention may be incorporated in the magenta dye forming layer to replace all or part of the conventional coupler since the invention coupler contains less unwanted blue absorption and can therefore help counteract the undesirable impact of the magnetic layer. Also, if a yellow colored magenta mask is employed, the amount of the mask may be diminished. On the other hand, if all or a portion of the blue absorption can be tolerated, considering the reduction achieved by the invention, then additional amounts of photographically useful groups which generate dye with blue absorbance, such as development inhibitors, can be added to improve sharpness, color and other important photographic properties.

Typically, the coupler is incorporated in a silver halide emulsion and the emulsion coated on a support to form part of a photographic element. Alternatively, the coupler can be incorporated at a location adjacent to the silver halide emulsion where, during development, the coupler will be in reactive association with development products such as oxidized color developing agent. Thus, as used herein, the term "associated therewith" signifies that the coupler is in the silver halide emulsion layer or in an adjacent location where, during processing, the coupler is capable of reacting with silver halide development products.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylene diamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethyl)aniline sulfate hydrate, 4-amino-3-methyl-N-ethyl-N-(β-hydroxyethyl)aniline sulfate, 4amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative working silver halide a negative image can be formed. Optionally positive (or reversal) image can be formed.

The magenta coupler described herein may be used in combination with other classes of magenta image couplers such as 3-acylamino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. No. 4,301,235; U.S. Pat. No. 4,853,319 and U.S. Pat. No. 4,351,897. The coupler may also be used in association with yellow or cyan colored couplers (e.g. to adjust levels of interlayer correction) and with masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The coupler may also be used in association with materials that accelerate or otherwise modify the processing steps e.g. of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrozides; sulfonamidophenols; and non color-forming couplers.

The couplers may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The coupler may further be used in combination with image-modifying compounds such as "Developer Inhibitor-Releasing" compounds (DIR's). DIR's useful in conjunction with the couplers of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

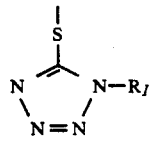

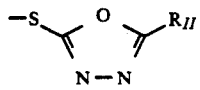

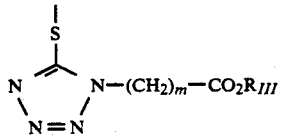

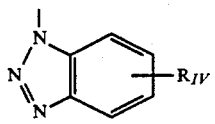

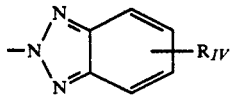

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the feature describe above. It is typical that the timing group or moiety is of one of the formulas:

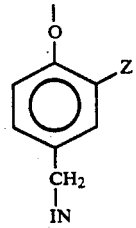

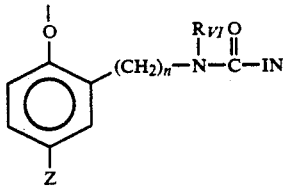

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

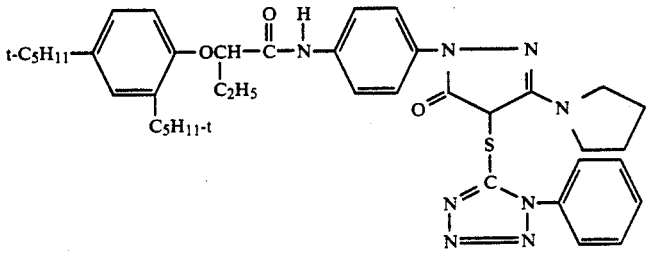

-continued

D2

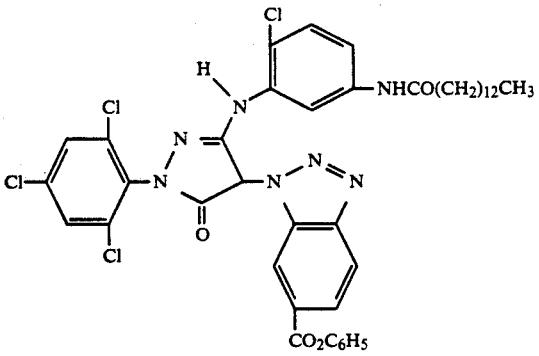

D3

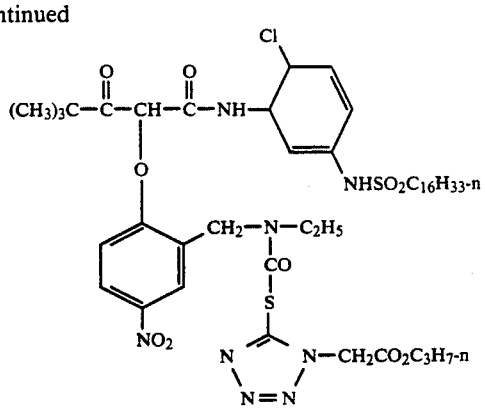

D4

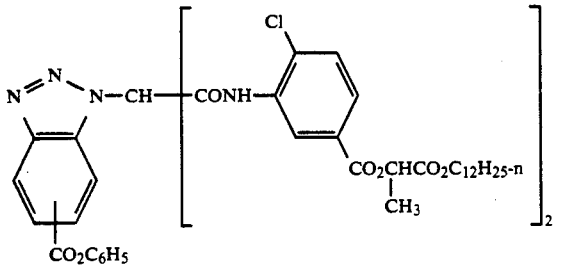

D5

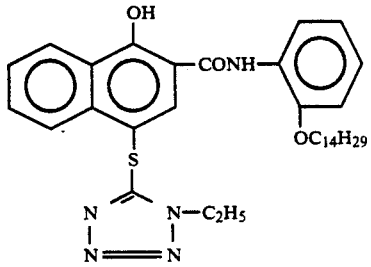

D6

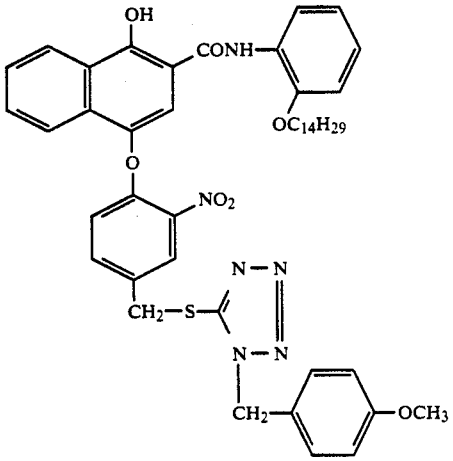

D7

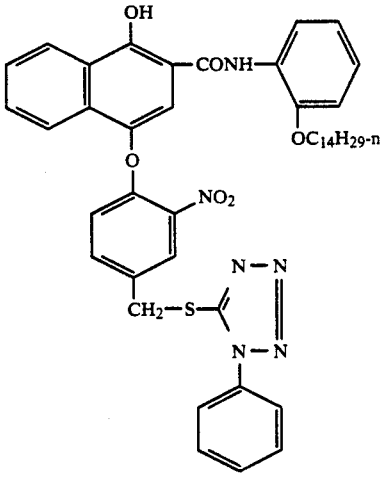

D8

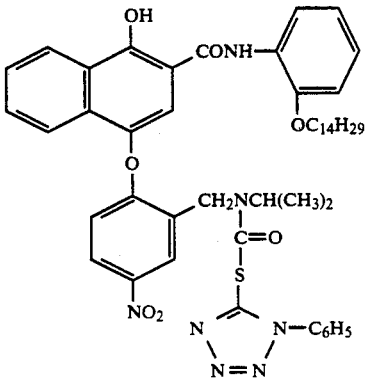

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; with epoxy solvents (EP 0 164 961); with nickel complex stabilizers (U.S. Pat. No.

4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The coupler compositions of this invention may be coated on a transparent support or a reflective support, such as a paper support, and may be used in color negative, reversal or color print materials.

The use and advantages of the 3-anilino-1-phenyl-5-pyrazolone coupler compositions of the invention are illustrated by the following examples, in which references are to parts by weight unless otherwise specified. The coupler solvent S1 utilized in many of these examples refers to mixed tritolyl phosphates. Structures of couplers B1–B9 used as comparative examples are shown below.

B1

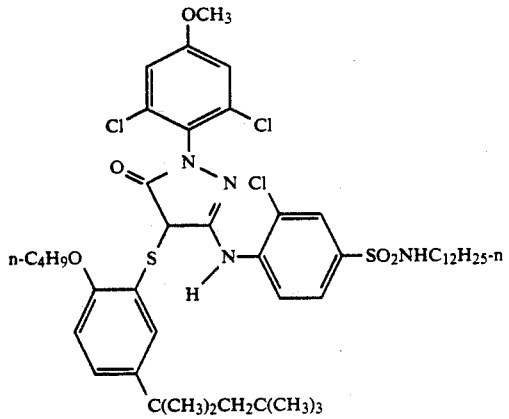

B2

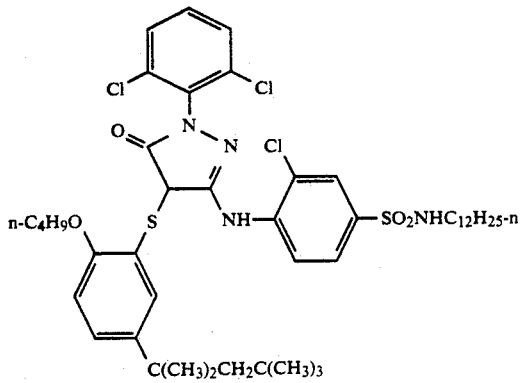

-continued

B3

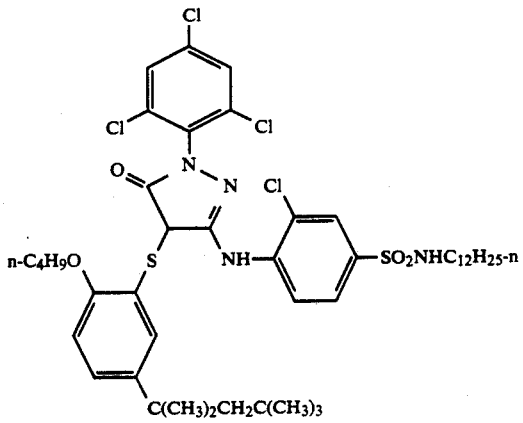

B4

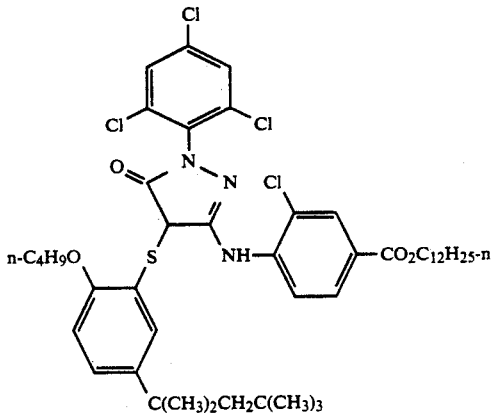

B5

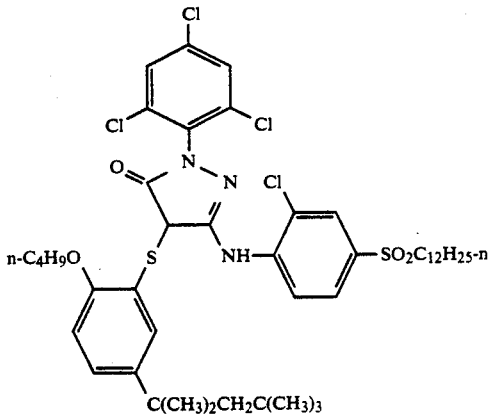

B6

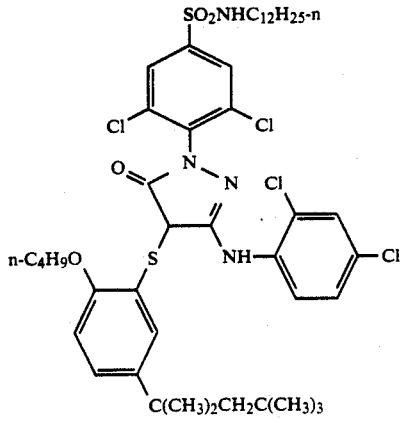

-continued

B7

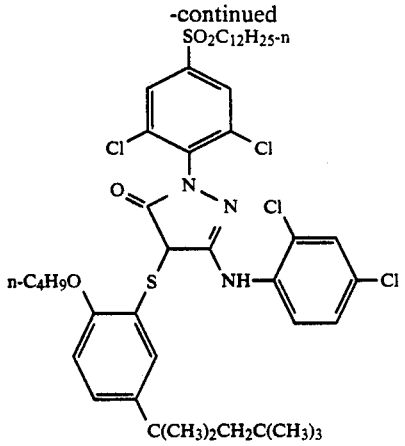

B8

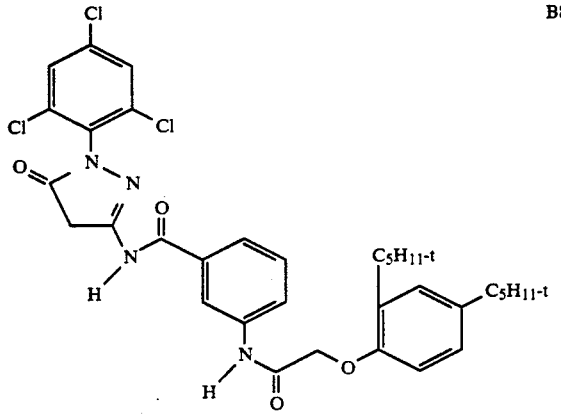

B9

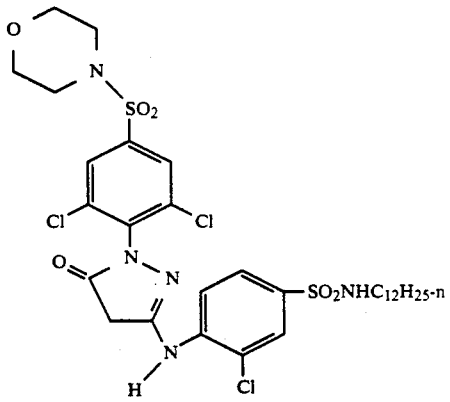

EXAMPLE 1

Synthetic Procedure for a Representative Coupler of this Invention (Coupler M-4)

Sulfuryl chloride (24.6 g, 0.183 mole) in 20 mL of acetic acid was added to a suspension of 29.9 g (0.175 mole) of p-methylsulfonylaniline (IV) in 200 mL of acetic acid over 25 min. The temperature rose to 45° C. After stirring for 15 min, 15.0 g (0.183 mole) of sodium acetate was gradually added to the suspension over 15 min at 35° C. After stirring for 15 min, an additional 24.6 g of sulfuryl chloride was added to the suspension at 35°–40° C. over 20 min. After stirring for 15 min, an additional 15.0 g of sodium acetate was added over 10 min at 40°–45° C. After stirring for 150 min, the suspension was poured slowly into 2000 mL of water, and the solid was collected by filtration. The product was oven dried at 50° C. Elemental and IR analyses indicated that the product was V (80% yield).

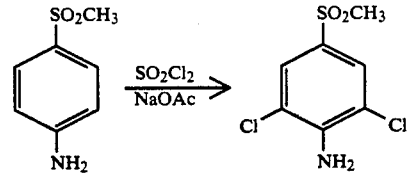

(IV) (V)

Sodium nitrite (5.0 g, 0.072 mole) was added to 35 mL of concentrated sulfuric acid at below 50° C. over 45 min. This solution was added to a suspension of 16.5 g (0.069 mole) of V in 90 mL of acetic acid at 55° C. over 35 min. After stirring at 50° C. for 30 min, the solution was cooled to 10° C. and a solution of 54.7 g (0.289 mole) of stannous chloride in 50 mL of hydrochloric acid was added at below 15° C. over 30 min. The suspension was stirred at ambient temperature for 75 min and then filtered. The residue was washed and two 50 mL portions of hydrochloric acid and then added to 500 mL of water. After heating on a steam bath for 15 min, a small amount of insoluble material was removed by filtration. The filtrate was basified using 3N sodium carbonate, and the solid which formed was collected by filtration and died in a vacuum oven at 50° C. The product was extracted into chloroform. The solid that was obtained after rotary evaporation of the chloroform was stirred in 50 mL of methanol and filtered. NMR and elemental analyses indicated the product to be VI (54% yield).

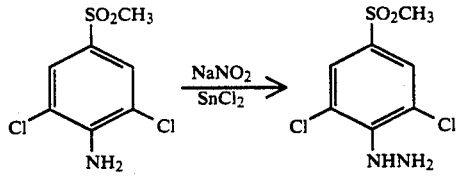

(V) (VI)

A mixture of 10.9 g (0.029 mole) of VII, 6.2 g (0.032 mole) of VIII and 0.25 g of p-toluenesulfonic acid in 25 mL of toluene was stirred and heated to 130° C. (external temperature) over 40 min, allowing volatiles to distill off. Another 1.0 g (0.005 mole) of VIII was added, and heating at 130° C. was continued for 90 min. A vacuum was then applied for 60 min. Then the mixture was allowed to cool. Thin layer chromatography showed the reaction to be virtually complete, with only a trace of VII remaining. The product IX was used in the next step without further purification.

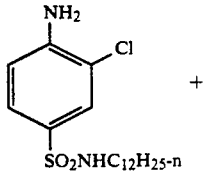

(VII)

-continued

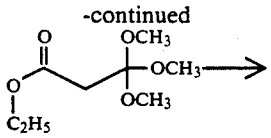

(VIII)

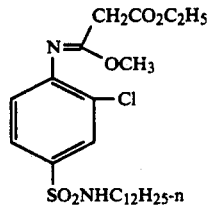

(IX)

About 0.029 mole of IX (from the previous step) and 7.5 g (0.029 mole) of VI were stirred and heated to 130° C. (external temperature) over 20 min. This temperature was maintained for 60 min, and then the mixture was allowed to cool and was added to 20 mL of methanol. A heavy precipitate was observed but was not filtered off. Sodium (0.75 g, 0.033 mole) in 10 mL of methanol was added, and the resulting dark red solution was stirred at ambient temperature for 15 min with brief heating on a steam bath to dissolve the solid. Glacial acetic acid (2 mL) was then added and the resulting precipitate was filtered off, washed with methanol and dried (yield - 9.3 g, 47%). Mass, NMR and IR spectra were all consistent with the structure of the desired product X.

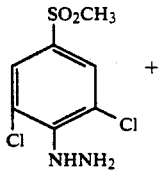

(VI)

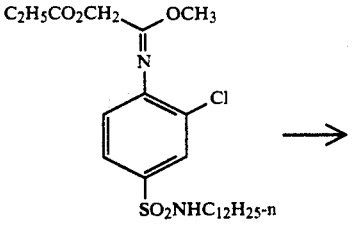

(IX)

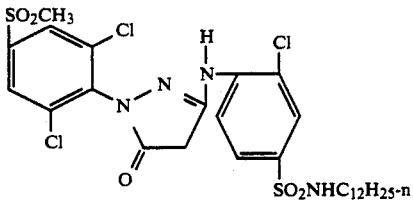

(X)

Sulfuryl chloride (2.0 g, 0.0148 mole) was added dropwise to a solution of 2-butoxy-5-t-octyl benzenethiol (4.0 g, 0.0136 mole) in 15 mL of dichloromethane. The mixture was stirred at ambient temperature for 30 min and then concentrated under vacuum to give a gum. A solution of 9.1 g (0.0134 mole) of X in 25 mL of DMF was added, and the mixture was stirred at ambient temperature for 240 min. It was then poured into 400 mL of 1.5N HCl and extracted with ethyl acetate. The extract was dried over magnesium sulfate, and then the solvent was removed under vacuum. The resulting oil was purified by column chromatography using silica gel and a 1:3 mixture of ethyl acetate and petroleum ether (60–80) as the eluting solvent. The oil (6.2 g) that was obtained was dissolved in 25 mL of acetic acid, and the solution was added to 600 mL of vigorously-stirred water. The white solid which precipitated was filtered off, washed with water and dried in a vacuum oven. NMR and IR spectra and elemental analyses of the product were all consistent with the desired product M4. The yield was 5.8 g (44%). High performance liquid chromatography indicated a purity of >97%.

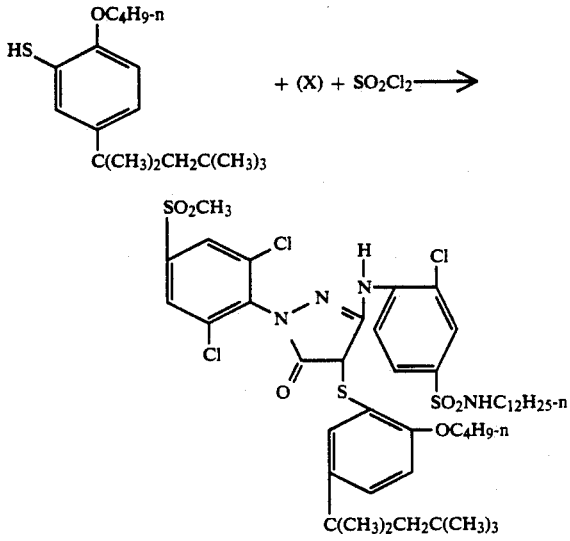

(M4)

EXAMPLE 2

Illustration of the Effect of the Invention Substituents on the Hues of Dyes Derived from 3-Anilino-1-Phenyl-5-pyrazolone Couplers Dispersions of the comparative couplers B1–B3 and B8 and of the couplers of this invention M1–M3 were prepared by dissolving the coupler in the coupler solvent S1 plus the auxiliary solvent 2-(2-butoxyethoxy)ethyl acetate and then dispersing this oil phase in an aqueous solution of gelatin and surfactant using an ultrasonic probe. The dispersions were chilled and washed for 6 hr at 4° C. to remove the auxiliary solvent. The dispersions contained approximately 8.8% coupler, 4.4% S1 and 6% gelatin by weight.

The dispersions were coated at 1.04 mmole/sq m together with a silver bromoiodide emulsion on a transparent acetate support in the format shown below. Hardened film strips were exposed through a 0–4 neutral density stepwedge and daylight V and WRATTEN 9 filters and subjected to a standard C-41 process at 37.8° C. The process consists of 2.5 min in color developer, 4 min in a ferric EDTA/PDTA bleach solution, 2 min wash, 4 min fix and 2 min final wash. Photographic gamma values were obtained from the slopes of plots of status M green density vs. exposure for processed samples. Absorption spectra of the dye-containing processed films were measured at a density near 1.0 on a spectrophotometer and the wavelengths of maximum absorption (λ max values) were recorded.

| Gelatin | 1.5 g/sq m |
|---|---|
| Gelatin | 2.42 g/sq m |
| BVSM* Hardener | 0.06 g/sq m |
| Coupler | 1.04 mmole/sq m |
| Coupler Solvent S1 | ½ coupler laydown |
| Silver Halide Emulsion | 1.61 g Ag/sq m |
| Acetate Support | |

*bis(vinlysulfonly) methane

Table I lists λ max values and gamma values for comparative couplers B1–B3 and B8 and for the couplers of this invention M1–M3. This series illustrates the effects of varying the substituent of the 1-phenyl ring (i.e. R1) on dye hue.

TABLE I

| Coupler | λmax(nm) (+ −0.5) | Gamma |
|---|---|---|
| B1 (comparative) | 539.5 | 4.8 |
| B2 (comparative) | 542.0 | 5.3 |
| B3 (comparative) | 546.0 | 4.7 |
| B8 (comparative) | 555.0 | 2.3 |
| M1 (invention) | 550.5 | 4.6 |
| M2 (invention) | 551.5 | 3.9 |
| M3 (invention) | 551.0 | 4.4 |

It is evident from the data in Table I that the dyes derived from the couplers M1–M3 of this invention, which have a strong electron-withdrawing sulfamoyl group on the 1-phenyl ring (R1), yield a dye that is more bathochromic than the dyes obtained from the comparative couplers B1–B3. The more bathochromic dye hue obtained from couplers M1–M3 is desirable to minimize unwanted blue light absorption and to maximize green light absorption by the chromogenically generated dye. As noted by W. C. Kress and P. J. Alessi in J. Appl. Phot. Eng. 9, 58 (1983), the maximum effective green sensitivity of commercial color papers is typically near 550 nm (see FIG. 2). It is desirable that the λmax of the magenta dye(s) in the green record(s) of a color negative film designed for printing onto these color papers be close to this same value of 550 nm. Even a para chloro 1-phenyl substituent, as in B3, is not sufficiently electron-withdrawing to result in a dye with a λmax suitably close to 550 nm. Although the couplers M1–M3 possess different coupling-off groups (Q), the absorption spectra of the three films are similar, which illustrates that the couplers of this invention can provide improved dye spectral absorption characteristics for a variety of coupling-off groups. The coupler M1 of this invention also yields a desirable high gamma value, which is comparable to those of the comparative couplers B1–B3 with the same coupling-off group. The four-equivalent coupler B8 is used commercially. From the comparative data in Table II it is evident that couplers M1–M3 of this invention all give gamma values which are higher than that obtained with the commercial magenta dye forming coupler B8. Thus M1–M3 offer activity and efficiency advantages over B8 which had not been anticipated.

The developing agent, 4-amino-3-methyl-N-ethyl-N-methanesulfonamidoethyl aniline, commonly used in color paper processes (such as the KODAK EKTACOLOR® RA process) yields dyes that are even more hypsochromic than the dyes formed from the C-41 process. Thus, the couplers of this invention are particularly useful in color paper materials for obtaining more bathochromic dyes with the proper visual hues.

EXAMPLE 3

Advantage of Using Two-Equivalent Couplers with Thio Coupling-Off Groups Instead of Four-Equivalent Couplers Prior examples of 3-anilino-1-phenyl-5-pyrazolone couplers that yield bathochromic dyes have been limited to four-equivalent couplers or to couplers with coupling-off groups other than arylthio or alkylthio groups. The four-equivalent couplers are not suitable for the practice of this invention because of their high propensity to react with formaldehyde or other hardeners. This can be illustrated by exposing coupler-containing films to formaldehyde and noting the changes in the dye density obtainable upon photographic processing. To obtain the data in Table II one set of film strips was suspended in a light-tight tank over a beaker containing 10 g of formaldehyde, and a solution of 14 g of water and 36 g of glycerol (60% RH) for 48 hr. A second set of strips was suspended for 48 hr over a water-glycerol solution without the beaker of formaldehyde. The strips were then exposed through a stepwedge, process (C-41) and the densities were measured. Values of the percent reduction in (Dmax-Dmin) for the samples exposed to formaldehyde relative to the samples exposed to water-glycerol only were determined.

Coatings of B8,B9 and M1 prepared as described in Example 2 were subjected to the formaldehyde test. The results in Table II indicate that the comparative four-equivalent couplers B8 and B9 experience severe loses in dye forming ability (about 90%) due to reaction with formaldehyde, whereas the coupler of this invention M1 shows only a very slight (3%) loss in dye forming ability after exposure to formaldehyde.

TABLE II

| Coupler | % Density Loss after Formaldehyde Exposure |
|---|---|
| B8 | 87 |
| B9 | 91 |
| M1 | 3 |

Since two-equivalent couplers, in principle, require reduction of only two atoms of silver to produce one molecule of dye, they can be much more efficient in forming dye images than four-equivalent couplers. However, many two-equivalent couplers are inefficient in forming dye images due to poor reactivity with oxidized developer or due to their tendency to undergo side reactions, which do not form dye. Chloro or other coupling-off groups have been used for many classes of couplers. However, as noted in "The Theory of The Photographic Process, Fourth Edition", T. H. James, Ed., Macmillan, New York, 1977, p357, pyrazolone couplers with halogen substituents in the 4-position are not useful because of their tendency to undergo side reactions. Other coupling-off groups may result in couplers of low reactivity. Thus it was not expected that the couplers of this invention with thio coupling-off groups would have the desirable high reactivity and high efficiency, indicated by the data in Example 2 and in subsequent examples. It was possible that the electron-withdrawing groups used to shift dye hues bathochromically and thio coupling-off groups would reduce the nucleophilicity of the 3-anilino-1-phenyl-5-pyrazolone couplers to such a degree that reactivity with oxidized developer would be too low to be practically useful, but this deleterious effect did not occur.

EXAMPLE 4

Spectral Advantages of the Coupler Compositions of this Invention

Dispersions of couplers B3, M1 and M5 with S1 (1:0.5) were prepared and coated as in Example 2. Film strips of these coatings were exposed, processed and analyzed as in Example 2. λmax values and gamma values associated with these film compositions are listed in Table III. This series further illustrates the use of electron-withdrawing substituents to obtain magenta dyes of the proper hue. Again the couplers M1 and M5 of this invention with at least two strongly electron-withdrawing substituents (sulfamoyl and cyano) at R1 and at R2 yield suitably bathochromic λmax values, whereas B3 with a chloro substituent at R1 does not.

TABLE III

| Coupler | λmax(nm) (+ −0.5) | Gamma |
|---|---|---|
| B3 (comparative) | 546.5 | 4.5 |
| M1 (invention) | 551.0 | 4.4 |
| M5 (invention) | 552.0 | 3.8 |

EXAMPLE 5

Further Illustration of Substituents in Each Ring to Achieve Bathochromic Hues Dispersions of the comparative couplers B4, B5 and B8 and the couplers of this invention M6–M11 were prepared and coated as in Example 2. The coupler solvent S1 was again used at a 1:0.5 coupler:S1 weight ratio. Film strips of the hardened coatings were exposed, processed and analyzed as in Example 2. The results obtained are summarized in Table IV. Couplers B4 and M6–M8 have a strongly electron-withdrawing alkoxycarbonyl substituent in the R2 position and couplers B5 and M9–M11 have a strongly electron-withdrawing alkylsulfonyl group at R2. As shown by the data in Table IV, B4 and B5, which have weaker electron-withdrawing chloro groups at R1, do not yield sufficiently bathochromic dyes. The couplers of this invention, M6–M11, which have strong electron-withdrawing groups in each ring, yield dyes having the desired bathochromic hues, as shown by the λmax values. The gamma values obtained with the couplers of this invention are suitably high to be useful in photographic materials, as indicated by comparison to the gamma obtained from the commercial coupler B8.

TABLE IV

| Coupler | λmax(nm) (+ −0.5) | Gamma |
|---|---|---|
| B4 (comparative) | 542.5 | 4.1 |
| M6 (invention) | 548.5 | 3.7 |
| M7 (invention) | 548.5 | 3.1 |
| M8 (invention) | 548.5 | 4.1 |
| B5 (comparative) | 546.5 | 4.2 |
| M9 (invention) | 551.0 | 3.2 |
| M10 | 551.0 | 3.2 |
| M11 | 551.0 | 3.3 |
| B8 (comparative) | 553.0 | 2.0 |

As noted above, couplers which yield more bathochromic dyes are desirable not only to maximize absorption in the region of550 nm but also to minimize unwanted blue light absorption. Often, the effective blue light sensitivity of color paper maximizes in the vicinity of 480 nm. (See FIG. 2 of W. C. Kress and P. J. Alessi, J. Appl. Photo. Eng. 9, 58 (1983).) Thus, to minimize unwanted modulation of blue light by magenta dye in printing color negative films, absorption by the magenta dyes in the color negative film should be as low as possible in the vicinity of 480 nm. Absorption spectra of films containing magenta dyes photographically generated from couplers B5 and M11 are compared in the figure. Note that the coupler of this invention, M11, not only yields a dye which is more bathochromic, but also produces less unwanted blue light absorption at 480 nm than the dye derived from the comparative coupler, B5.

EXAMPLE 6

Additional Comparative Examples

Dispersions of the comparison couplers B6 and B7, and of the couplers of this invention M12–M17, were prepared using the coupler solvent Sl as in Example 2. These were coated as in Example 2, and hardened film strips were exposed, processed and analyzed as in Example 2. The results obtained are summarized in Table V. In this example all of the couplers have sulfamoyl or alkylsulfonyl substituents in the R1 position and the R2 substituent on the 3-anilino ring is varied. Comparative couplers B6 and B7 have chloro substituents at R2, whereas M12–M17 of this invention have strong electron withdrawing R2 groups. It is evident from the data in Table V that M12–M17 yield dyes having the desired bathochromic hues with λmax values near 550 nm, whereas B6 and B7 yield dyes which are too hypsochromic. The gamma values of the couplers of this invention are similar to those of the comparative couplers.

TABLE V

| Coupler | λmax(nm) (+ −0.5) | Gamma |
|---|---|---|
| B6 (comparative) | 545.0 | 3.4 |
| M12 (invention) | 549.5 | 3.1 |
| M13 (invention) | 549.5 | 3.9 |
| M14 (invention) | 550.5 | 3.1 |
| B7 (comparative) | 546.0 | 3.3 |
| M15 (invention) | 551.0 | 3.4 |
| M16 (invention) | 550.5 | 3.2 |
| M17 (invention) | 550.5 | 3.5 |

EXAMPLE 7

Combinations of the Couplers of the Invention with Coupler Solvents and Addenda Dispersions of the coupler B3 were prepared with coupler solvents S1 and C2, both at a 1:1 B3:coupler solvent weight ratio. Dispersions of coupler M1 were prepared with C2 at 1:1 and with C2 plus aniline A1 at a 1:0.8:0.2 M1:C2:A1 weight ratio. These dispersions were prepared by dissolving the coupler in a mixture of coupler solvent, aniline A1 (optional) and cyclohexanone. The coupler:cyclohexanone weight ratio was 1:3. This mixture was then added to an aqueous solution of gelatin and ALKANOL XC surfactant. The two-phase mixture was then passed through a colloid mill to disperse the coupler-containing oil phase in the aqueous phase in the form of small droplets. The dispersion was then chilled, noodled and washed to remove the auxiliary cyclohexanone solvent. The resulting dispersions contained approximately 2% by weight of coupler and 6% by weight of gelatin.

The dispersions were then coated on a transparent support together with a silver bromoiodide emulsion in the format shown below. Coatings were then exposed through a stepwedge and subjected to variants of the KODAK FLEXICOLOR (C-41) process described below. One set of film samples was processed with an acetic acid stop bath between the development and bleach steps (process A). A second set of films was processed without a stop bath and with the bleach pH adjusted to 6.0 instead of the normal 5.25 (process B). This is intended to simulate behavior in a "seasoned" bleach whose pH increases due to carry-over of base from the developer solution. The difference between Dmin values (densities obtained in unexposed portions of the films) between process A and process B are due to continued coupling between coupler and developer carried over into the bleach. Both the lack of a stop bath and the high bleach pH in process B aggravate continued coupling. It is desirable to minimize Dmin density and Dmin variability due to continued coupling. Since conditions similar to process B are encountered in simplified trade processing, it is desirable to minimize continued coupling, as measured by the delta Dmin of process B - process A. These delta Dmin values are listed in Table VI along with λmax values and gamma values (obtained from plots of status M green density versus exposure).

| COATING FORMAT |
|---|
| 2.6 g/sq m Gelatin + 1.75 weight % BVSME* Hardener |
| 0.54 mmole/sq m Coupler |
| Coupler Solvent + or − A1 @ equal weight to coupler |
| 3.77 g/sq m Gelatin |
| 1.08 g/sq m Silver Emulsion |
| //////Cellulose Acetate Butyrate Support////// |

*bis vinlysulfonylmethylether

PROCESSING CONDITIONS

| Step | Solution (all at 100° F.) | Time |
|---|---|---|
| 1 | C-41 KF12 Developer | 3'15" |
| 2A | Stop Bath, then | 1' |
| or | Standard C-41 Bleach II | 4' |
| 2B | Bleach II Adjusted to pH = 6.0 | 4' |
| 3 | Wash | 3' |
| 4 | C-41 Fix | 4' |
| 5 | Wash | 3' |

Also included in this comparison was a 1:1 dispersion of M1 plus C2 to which was added the DIR coupler D1 (shown above) at a M1:D1 weight ratio of 1:0.045. Data for exposed and processed film samples having this composition are included in Table VI.

TABLE VI

| Imaging Coupler | Coupler Solvent | Aniline | DIR Coupler | Delta Dmin Process B-A | Gamma | λmax(nm) |
|---|---|---|---|---|---|---|
| B3(1.0) | S1(1.0) | none | none | 0.191 | 2.10 | 548 |
| B3(1.0) | C2(1.0) | none | none | 0.071 | 1.78 | 544 |
| M1(1.0) | C2(1.0) | none | none | 0.073 | 1.75 | 549 |
| M1(1.0) | C2(0.8) | A1(0.2) | none | 0.040 | 1.83 | 549 |
| M1(1.0) | C2(1.0) | none | D1(0.045) | 0.088 | 0.88 | 549 |

weight ratios are in parentheses

The data in Table VI illustrate that the continued coupling of B3 (i.e. delta Dmin), which is high with coupler solvent Sl, can be reduced substantially (from 0.191 to 0.071) by dispersing B3 with coupler solvent C2. However, use of C2 with B3 leads to an unacceptably hypsochromic hue (λmax=544 nm). Surprisingly, coupler M1 of this invention can be used together with C2 to yield BOTH low continued coupling and a suitably bathochromic hue (λmax=549). In addition the gamma value obtained with the M1 plus C2 combination remains high. This illustrates the advantageous combination of the couplers of this invention with crrbonamide coupler solvents. Aniline or amine addenda such as A1 can be added to coupler compositions of this invention to further reduce continued coupling, while maintaining a desirable dye hue and suitable gamma. This is illustrated by data for the combination of M1 , C2 and A1, which yields a delta Dmin of only 0.040. The couplers of this invention can also be used in combination with any type inhibitor releasing couplers (DIRs and DIARs). The above data illustrate that low continued coupling and desirable bathochromic hues are obtained with a composition consisting of M1 , C2 and D1. The gamma value is reduced as expected for a properly functioning DIR coupler.

These illustrations should facilitate the construction by one skilled in the art of other coupler compositions and of other photographic materials that advantageously utilize the 3-anilino-1-phenyl-5-pyrazolone magenta dye forming couplers of this invention.

This invention provides a material and process for obtaining a magenta image dye of more bathochromic hue. The use of a specified strongly withdrawing parent with a thio coupling off group provides the advantageous results.

What is claimed is:

1. A photographic material comprising a support bearing at least one photosensitive silver halide emulsion layer having associated therewith a magenta dye-forming coupler having the formula:

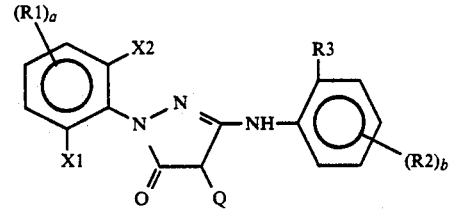

wherein (a) at least one of X1, X2 and R1 and at least one of R2 and R3 is a substituent individually selected from carbamoyl, alkoxycarbonyl, aryloxycarbonyl, sulfamoyl, alkylsulfonyl, arylsulfonyl, alkoxysulfonyl, aryloxysulfonyl, alkylsulfoxyl, arylsulfoxyl, acyloxy, cyano, nitro and trifluoromethyl;

(b) the substituents X1, X2, R1, R2 and R3 not selected from the (a) group may be selected from halogen, alkyl, alkoxy, aryloxy, acylamino, alkylthio, arylthio, sulfonamido, alkylureido, arylureido, alkoxycarbonylamino, and aryloxycarbonylamino, and in the case of R3 hydrogen;

(c) substituents R1 and R2 are para or meta to the carbon attached to the nitrogen atom;

(d) a and b are 1 to 3;

(e) Q is an alkylthio or arylthio coupling-off group.

2. The material of claim 1 wherein X1, X2 and R3 are halogen atoms.

3. The material of claim 1 wherein an R1 is para located.

4. The material of claim 1 wherein Q is arylthio.

5. The material of claim 4 wherein Q is an ortho substituted arylthio group.

6. The material of claim 5 wherein Q has the formula:

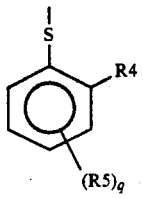

wherein R4 and R5 are selected from alkyl, alkoxy, aryloxy, carbonamido, ureido, carbamate, sulfonamido, carbamoyl, sulfamoyl, acyloxy, alkoxycarbamoyl, aryloxycarbamoyl, amine, halogen, hydrogen and carboxyl; and q=0, 1 or 2.

7. The material of claim 6 wherein the number of carbon atoms in R4 and R5 combined is at least 4.

8. The material of claim 7 wherein the combined pi value of the thio ring substituents R4 and R5 is at least 2.5.

9. The material of claim 6 wherein R4 and R5 are selected from carbonamido and alkyl.

10. The material of claim 9 wherein R4 is alkyl carbonamido.

11. The material of claim 9 wherein R5 is alkyl carbonamido.

12. The material of claim 9 wherein both R4 and R5 are alkyl.

13. The material of claim 1 wherein at least one substituent X1, X2, R1, R2 or R3 is selected from the group consisting of alkylsulfonyl, alkoxycarbonyl, sulfamoyl and carbamoyl, cyano and trifluoromethyl.

14. The material of claim 1 additionally comprising an organic coupler solvent containing a carbonamide, a sulfoxide, a phenol or a phosphate.

15. The material of claim 1 additionally comprising an alkyl or aryl amine compound.

16. The material of claim 1 additionally comprising a layer containing magnetic particles.

17. The material of claim 16 additionally comprising a yellow-colored dye-forming masking coupler in an amount less than needed with a magenta coupler of more hypsochromic hue.

* * * * *